US006158748A

United States Patent [19]

Caeran

[11] Patent Number: 6,158,748

[45] Date of Patent: Dec. 12, 2000

[54] SKATE

[75] Inventor: Francesco Caeran, Montebelluna, Italy

[73] Assignee: Benetton Group S.p.A., Ponzano Veneto, Italy

[21] Appl. No.: 09/273,315

[22] Filed: Mar. 22, 1999

[30] Foreign Application Priority Data

Mar. 31, 1998 [IT] Italy ..... TV98A0050

[51] Int. Cl.[7] ..... A63C 17/14

[52] U.S. Cl. ..... 280/11.22; 280/11.28

[58] Field of Search ..... 280/11.19, 11.22, 280/11.23, 11.27, 11.28, 841, 11.12; 36/115, 125, 102, 118.2, 118.9

[56] References Cited

U.S. PATENT DOCUMENTS

| | | | |
|---|---|---|---|
| 4,839,972 | 6/1989 | Eddress et al. . | |
| 5,342,071 | 8/1994 | Soo | 280/11.22 |
| 5,462,297 | 10/1995 | Lee | 280/11.22 |
| 5,634,648 | 6/1997 | Tonel et al. | 280/11.22 |
| 5,957,470 | 9/1999 | Powell | 280/11.22 |

FOREIGN PATENT DOCUMENTS

| | | | |
|---|---|---|---|
| 0 774 282 | 5/1997 | European Pat. Off. . | |
| 0 778 058 | 6/1997 | European Pat. Off. . | |
| 9312847 | 7/1993 | WIPO | 280/11.22 |
| 97/18019 | 5/1997 | WIPO . | |
| 97/32637 | 9/1997 | WIPO . | |

*Primary Examiner*—Richard M. Camby
*Attorney, Agent, or Firm*—Guido Modiano; Albert Josif; Daniel O'Byrne

[57] ABSTRACT

An improved skate with in-line wheels or with an ice-skating blade, includes a shoe which is articulated in the metatarsal region so as to form a sole which is divided into a front part and a rear part. The front part is rigidly associated with a first supporting frame for the wheels or for a blade, while the rear part is slidingly associated with a second supporting frame for the wheels or for a blade. The first and second frames are mutually articulated approximately in the region below the metatarsus, allowing to improve the adaptation of the skate to the natural movement of the foot.

7 Claims, 2 Drawing Sheets

SKATE

BACKGROUND OF THE INVENTION

The present invention relates to an improved skate.

In the field both of roller and ice skating the problem of optimizing the skating action given the particularly rigid structure of the skates, is currently strongly felt.

U.S. Pat. No. 1,228,544 discloses an ice skate composed of a soft shoe having a sole rigidly connected to a first front plate and to a second rear plate.

The first plate, which affects the entire forward region of the foot up to the metatarsal region, is rigidly coupled to a first blade, while the second plate is rigidly coupled to a second blade, which is slidingly connected, at one end, at the first blade in the metatarsal region.

In this skate, a flexing of the foot and therefore of the shoe is matched by a combined rotary and translatory motion of the rear blade, which accordingly generates no resistance to the flexing of the shoe.

However, since the metatarsal region is intensely stressed during skating, particularly during thrusting or braking and therefore when the weight of the user is added to the thrusting force or the inertia of the body, this structure can compromise the precise alignment of the front blade with respect to the rear blade, causing vibrations which in practice decrease, instead of increasing, control and comfort in using the skate.

U.S. Pat. No. 1,603,588 discloses an ice skate and a roller skate which comprise a shoe below whose sole a first blade or a first wheel supporting truck is rigidly coupled in the forward foot region.

At the heel region of the shoe there is provided instead a rigid connection between the heel and a second blade or truck, which is rotatably articulated to the preceding blade or truck in the region below the plantar arch.

In this skate it is evident that the rotation of the shoe is prevented, for obvious kinematic reasons, or is such as to cause deformations and stresses on the skate.

The rotation of the rear part alone of the blade or of the frame or of the wheels in fact entails the longitudinal compression of the sole during the movement of the foot, and this can produce uncomfortable depressions in the sole.

At the same time, indeed because the sole is compressed during the movement of the foot, it generates resistance to the movement of the foot, increasing the fatigue of the user and preventing the free movement of the foot.

SUMMARY OF THE INVENTION

The aim of the present invention is to solve the above-mentioned problems, eliminating the drawbacks of the cited prior art, by providing a skate which allows to effectively assist the movement and flexing of the foot and of the shoe during sports practice both on a track and on ice.

Within the scope of this aim, an important object of the present invention is to provide a skate which allows to avoid, during sports practice, the formation of depressions of the sole inside the shoe.

Another important object of the present invention is to provide a skate which allows to maintain its rigidity characteristics, which are required for the correct use of the sports implement.

Another object of the present is to provide a skate which is structurally simple and can be manufactured with conventional machines and equipment.

This aim, these objects and others which will become apparent hereinafter are achieved by an improved skate, characterized in that it comprises a shoe which is articulated in the metatarsal region so as to form a sole which is divided into a front part and a rear part, which in a downward region are respectively rigidly associated with a first wheel or blade supporting frame and slidingly associated with a second wheel or blade supporting frame which are mutually articulated approximately in the region below the metatarsus.

BRIEF DESCRIPTION OF THE DRAWINGS

Further characteristics and advantages of the invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1:
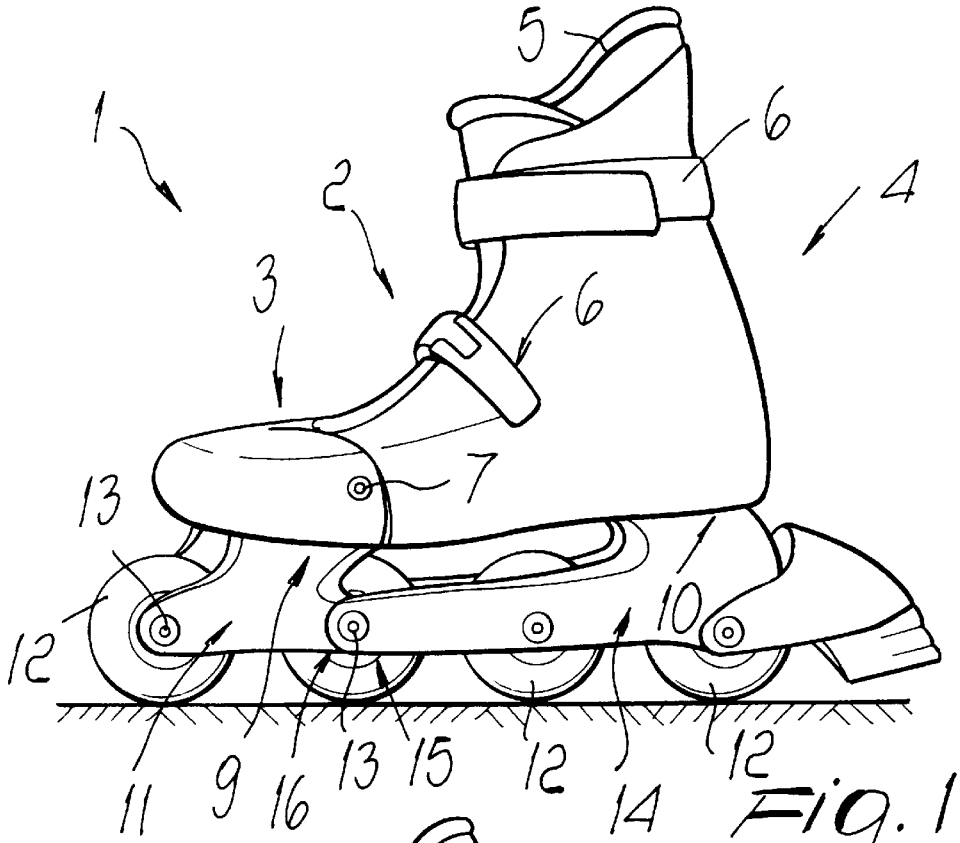
FIG. 1 is a side view of a skate in the condition in which it is not articulated.
Figure 2:
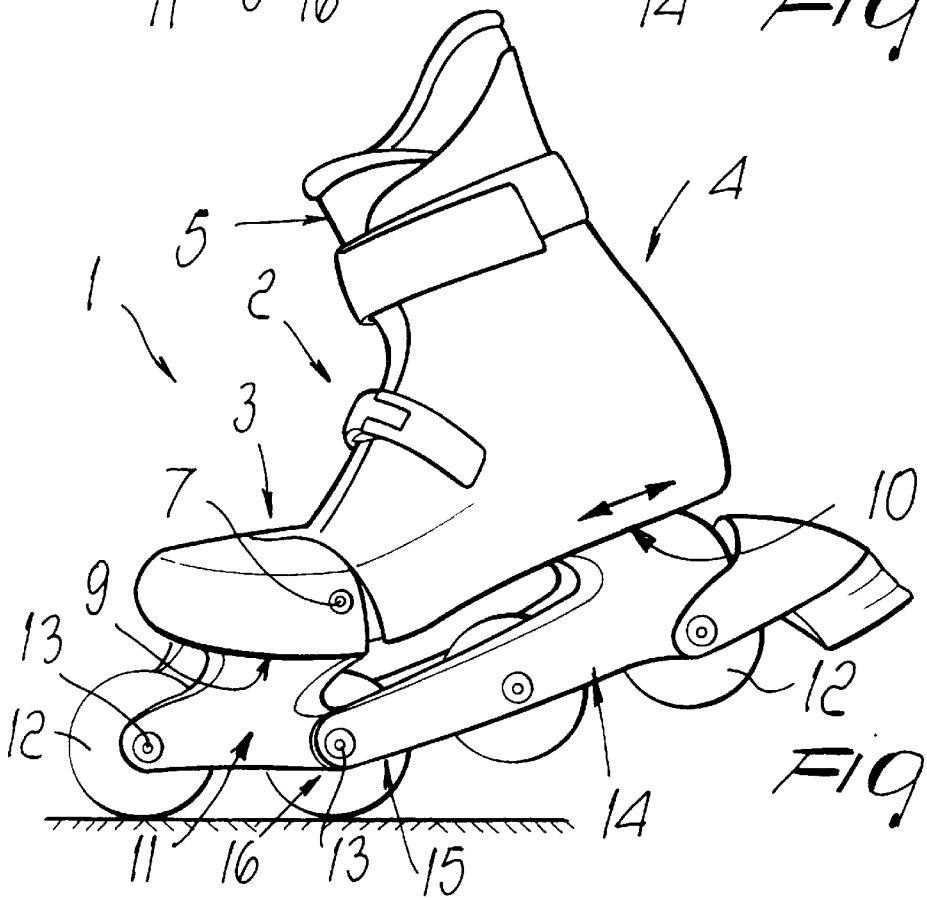
FIG. 2 is a view, similar to FIG. 1, of the articulated condition of the skate.
Figure 4:
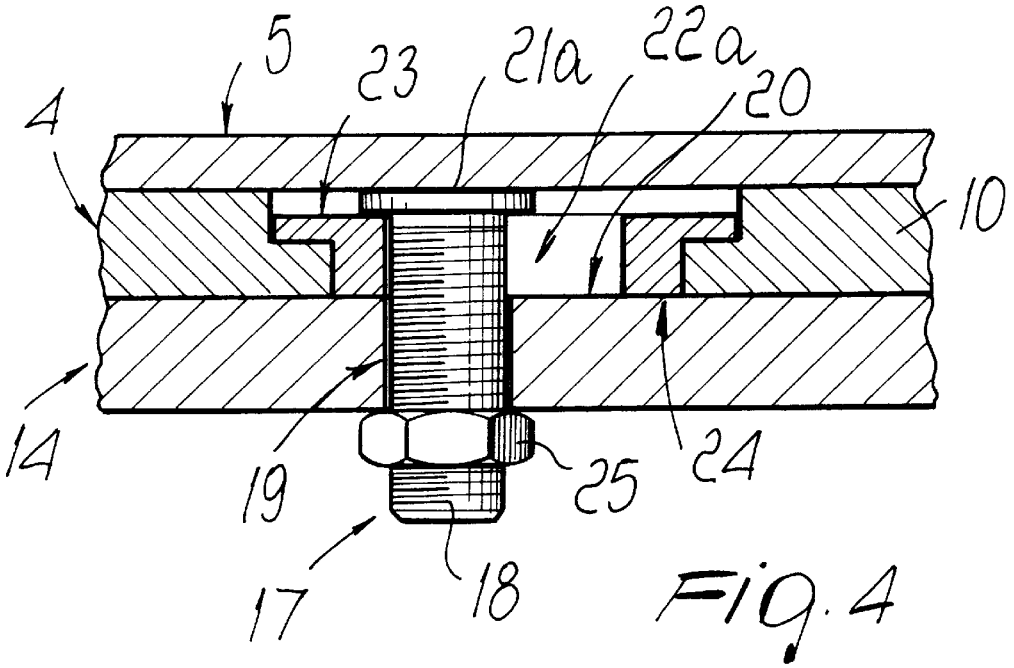
FIG. 4 is a sectional view, taken along the plane IV—IV of FIG. 3.
Figure 3:
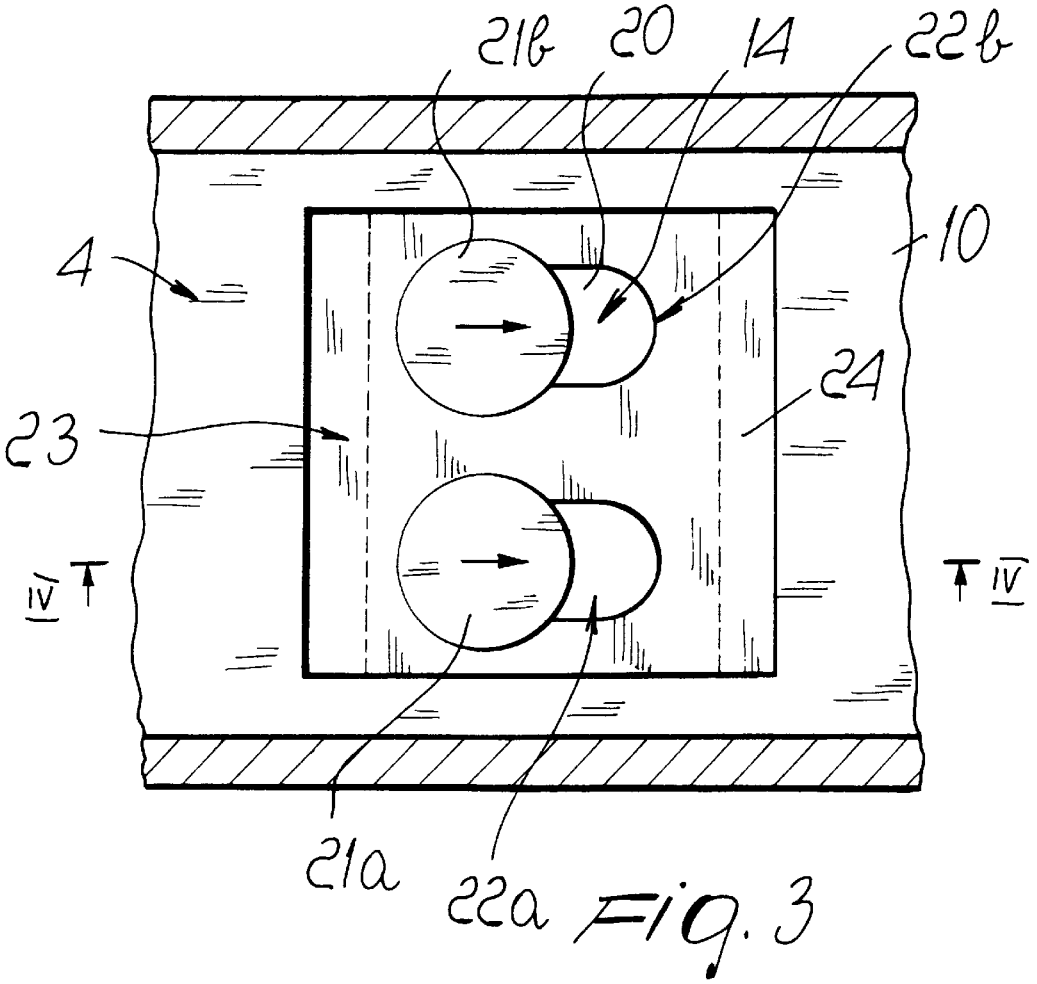
FIG. 3 is a partially sectional top view of the sliding connection of the rear part of the sole to the second frame.

With reference to the above figures, the reference numeral 1 designates a skate, which is constituted by a shoe 2 articulated at the metatarsal region.

The illustrated embodiment shows a skate with in-line wheels, but substantially the same structure can be used for an ice skate.

In this particular embodiment, the shoe is constituted by a containment shell 4 for a soft innerboot 5. The shell has flaps which can be mutually fastened by means of adapted and conventional devices, such as levers or straps 6.

The articulation of the metatarsal region 3 is achieved by fully or partially dividing the shoe at said region. The rotary connection is advantageously achieved by using a pair of pivots or studs 7, or any other suitable means.

This division of the shoe into two parts forms a sole 8 which is in turn divided into a front part 9 and a rear part 10.

The front part 9 of the sole 8 is rigidly associated, in a downward region, at a first frame 11 which is preferably shaped like an inverted U and between whose wings one or two wheels, designated by the reference numeral 12, are pivoted so as to be able to rotate freely by means of suitable second pivots 13.

The rear part 10 of the sole 8 is slidingly associated, in a downward region, at a second frame 14 which is also substantially U-shaped and between whose wings additional wheels 12 are pivoted so as to be able to rotate freely; the front ends 15 of said second frame 14 are pivoted so as to be able to rotate freely at the respective rear ends 16 of the first frame 11, for example by means of one of the second pivots 13.

The sliding connection between the rear part 10 of the sole 8 and the second frame 14 occurs by means of a pair of screws 17, the shank 18 of which passes at adapted holes 19 formed at the flat base 20 of the second frame 14 for supporting the rear part 10 of the sole 8.

Screws 17 have a head, designated by the reference numeral 21*a* and 21*b*, which has a disk-like shape. The shank 18 acts at an adapted pair of slots 22*a* and 22*b* formed at the rear part 10 of the sole 8 that is adjacent to the holes 19.

The head 21*a* and 21*b* of each one of the screws 17, which are preferably arranged at a same axis lying transversely to the second frame 14, is arranged at a recess 23 formed on the surface of the rear part 10 and of the sole 8 adjacent to the soft innerboot 5.

In an equivalent embodiment, the recess 23 and the slots 22*a* and 22*b* can be formed at a single insert 24 which has a preferably T-shaped cross-section and can be accommodated in a complementarily shaped seat formed at the rear part 10 and at the sole 8.

The slots 22*a* and 22*b* are arranged along an axis lying longitudinally to the second frame 14 and allow, if said second frame is lifted with respect to the ground, the sliding therein of the shanks 18 and of the screws 17.

Screws 17 can also be tightened by means of nuts 25 which can be associated with the tips of the shanks 18 that protrude beyond the lower surface of the flat base 20 of the second frame 14.

It has thus been observed that the invention has achieved the intended aim and objects, a skate having been provided which can effectively assist the flexing of the foot and of the shoe, since the translatory motion of the rear part 10 of the sole 8 avoids the compression of said sole, so as to avoid creating small depressions in the shoe, which accordingly does not contrast flexing thereof and flexing of the foot.

At the same time, it is observed that the first frame 11 is in no way weakened, since the components suitable to allow the sliding of the rear part 10 and of the sole 8 are accommodated at the second frame 14: accordingly, the first frame 11 is intact and allows to maintain optimum rigidity in the region that is most intensely loaded during sports practice.

A structure is thus achieved which allows to improve the adaptation of the skate to the natural movement of the foot.

The skate according to the invention is susceptible of numerous modifications and variations, within the scope of the appended claims.

The materials and the dimensions that constitute the individual components of the invention may also of course be the most appropriate according to specific requirements.

The disclosures in Italian Patent Application No. TV98A000050 from which this application claims priority are incorporated herein by reference.

What is claimed is:

1. An improved skate, comprising a shoe which is articulated in the metatarsal region so as to form a sole which is divided into a front part and a rear part, said front part being rigidly associated with a first frame for supporting wheels, said rear part being slidingly associated with a second frame for supporting wheels, said first frame and said second frame being mutually articulated approximately in the region below the metatarsus, said first and second frames being U-shaped, the front ends of said second frame being pivoted so as to be able to rotate freely at the respective rear ends of said first frame by means of one of the pivots of said wheels.

2. The skate according to claim 1, wherein said shoe comprises a containment shell for a soft innerboot, said shell having flaps which can be mutually fastened by fastening means, wherein said articulation in the metatarsal region is achieved by fully or partially dividing said shoe at said region, the rotary connection being achieved by using a pair of pivots or studs.

3. The skate according to claim 1, wherein said sliding connection between said rear part of said sole and said second frame occurs by means of a pair of screws, each having a shank that passes at holes formed at a flat base which constitutes said second frame for supporting said rear part of said sole.

4. The skate according to claim 3, wherein said screws have a head which has a disk-like shape, said shank acting at a pair of slots formed at said rear part of said sole adjacent to said holes.

5. The skate according to claim 4, wherein said head of each one of said screws, which are arranged at a same axis arranged transversely to said second frame, are arranged at a recess formed on the surface of said rear part of said sole which is adjacent to said soft innerboot.

6. The skate according to claim 5, wherein said recess and said slots are formed at a single insert which is T-shaped in transverse cross-section and can be accommodated within a complementarily shaped seat formed at said rear part of said sole.

7. The skate according to claim 6, wherein said slots are arranged along an axis lying longitudinally to said second frame and allow, if said second frame is lifted with respect to the ground, the sliding therein of said shanks of said screws, said screws being lockable by means of nuts which can be associated with the tips of said shanks which protrude beyond a lower surface of said flat base of said second frame.

* * * * *